US006443606B1

(12) United States Patent
Mochizuki

(10) Patent No.: US 6,443,606 B1
(45) Date of Patent: Sep. 3, 2002

(54) VEHICLE HEADLAMP

(75) Inventor: Mitsuyuki Mochizuki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/688,508

(22) Filed: Oct. 16, 2000

(30) Foreign Application Priority Data

Oct. 19, 1999 (JP) ..... 11-297482

(51) Int. Cl.[7] ..... F21W 101/10

(52) U.S. Cl. ..... 362/513; 362/512; 362/539; 362/282; 362/322

(58) Field of Search ..... 362/512, 513, 362/538, 539, 282, 277, 322, 324

(56) References Cited

U.S. PATENT DOCUMENTS 5,113,319 A * 5/1992 Sekiguchi et al. ..... 362/61
5,213,406 A 5/1993 Neumann et al. ..... 362/61
5,488,546 A * 1/1996 Sato et al. ..... 362/61
5,899,559 A * 5/1999 Lachmayer et al. ..... 362/513
2001/0010634 A1 * 8/2001 Yokoi ..... 362/539
2001/0040810 A1 * 11/2001 Kusagaya ..... 362/539

FOREIGN PATENT DOCUMENTS

GB 2332742 A 6/1999 ..... B60Q/1/076
GB 2341672 A 3/2000 ..... B60Q/1/14
GB 2341673 A 3/2000 ..... B60Q/1/14

* cited by examiner

*Primary Examiner*—Laura K. Tso
(74) *Attorney, Agent, or Firm*—Fish & Richardson P.C.

(57) ABSTRACT

A shade driving unit 24 provided in a vehicle headlamp is a solenoid for displacing a movable iron core 36 that pivots a movable shade to a high beam or a low beam position. An inverted diode parallel to the coil is connected to a solenoid driving circuit. A current is kept flowing through the coil by the induced electromotive force generated across the coil after the supply of power to the coil is cut off to gradually de-excite the movable iron core 36. Thus, the movable shade 22 is prevented from strongly butting against a positioning projected portion 26*b*.

12 Claims, 5 Drawing Sheets

VEHICLE HEADLAMP

FIELD OF THE INVENTION

The present invention relates to a vehicle headlamp arranged to vary the light distribution of the headlamp by moving a movable shade.

BACKGROUND OF THE INVENTION

Vehicle headlamps are arranged to emit low or high beams by causing reflectors to reflect light from light sources forward. However, because the light distribution patterns differ between low and high beams, it is common to use a light source bulb having two light sources or two light source bulbs for the purpose of switching between the low and high beams.

Nonetheless, there is a vehicle headlamp that uses a single light source for switching beams, particularly, a two-lamp type headlamp that uses a discharge bulb as a light source bulb.

A sole light source with a movable shade may be used to switch beams. In this case, the shade is made movable between two positions by a shade driving unit. The two positions provide different degrees of screening of light from a light source that radiates to a reflector.

The shade driving unit of a solenoid type allows for a simplified construction. The solenoid shade driving unit is equipped with a solenoid and an elastic member for urging a movable iron core of the solenoid toward a non-excited position. Further, the solenoid shade driving unit operates to move the movable shade to the high-beam position by displacing the movable iron core to an excited position when power is supplied to the coil of the solenoid. It also operates to move the movable shade to the low-beam position by displacing the movable iron core to the non-excited position when the supply of power to the coil is cut off.

While the movable shade is in the low-beam position, the light distribution pattern formed by the emission of the low beam is varied when the movable shade wobbles because of vehicle vibration. If the cutoff line (the light-shade border line) of the pattern also wobbles, the forward visibility is lowered.

However, by providing a positioning member for positioning the movable shade at the low-beam position to butt against the movable shade when the movable shade is moved to the low-beam forming position, the wobble of the movable shade may be suppressed.

Switching beams from the high beam to the low beam by cutting off the power supply to the solenoid may create the following problem.

The movable shade is moved to the low-beam position as the movable iron core is displaced to the non-excited position when the supply of power to the coil of the solenoid is cut off. The movable shade is caused to butt against the positioning member with strong force because of the elastic urging force of the elastic member. The movable shade bounces off toward the high-beam position after its impact with the positioning member.

Hence, the light distribution pattern tends to be unstable when the beams are switched.

The problem of this kind arises from not only switching beams from low to high by moving such a movable shade but arises generally from switching beams by moving the movable shade.

An object of the present invention is to provide a vehicle headlamp that is designed to switch beams by moving a movable shade and that is capable of not only suppressing a knocking sound when the beam is switched but also stabilizing a light distribution pattern.

SUMMARY OF THE INVENTION

The present invention is intended to accomplish the object above by providing a novel solenoid driving circuit.

A vehicle headlamp according to an embodiment of the invention comprises a light source, a reflector for reflecting light from the light source forward, a movable shade capable of shading part of light incident on the reflector from the light source, and a shade driving unit for moving the movable shade between a first and a second position where an incident light shading quantity has different values.

The shade driving unit includes a solenoid and an elastic member for urging the movable iron core of the solenoid toward the non-excited position and for operating to move the movable shade to the first position by displacing the movable iron core to the excited position when power is supplied to the coil of the solenoid. The shade driving unit also moves the movable shade to the second position by displacing the movable iron core to the non-excited position when the supply of power to the coil is cut off. The vehicle headlamp further includes a positioning member for positioning the movable shade to the second position by butting against the movable shade when the movable shade moves to the second position. It also includes an inverted diode or capacitor connected in parallel to the coil, which is connected to a solenoid driving circuit for driving the solenoid.

The above "light source" is not limited to a specific kind but maybe any discharge light emitting bulb portion, for example, an incandescent bulb filament of such as a halogen bulb.

The above "movable shade" may be of any kind capable of shading part of light incident on the reflector from the light source bulb and not limited to a specific configuration.

The above "first and second positions" are not limited to any specific positions but may be two positions where a quantity of incident light shading has different values or may be a set of two positions for high- and low-beam or otherwise may be a set of positions for other beam emissions (e.g., a position for a fog beam, a position for an intermediate beam between the high and low beams and so forth).

The above "inverted diode" means a diode disposed in the inverted direction for supplying power to the coil of the solenoid.

The above "inverted diode" or "capacitor" may be used independently or may be connected in series with a resistor and the like.

The vehicle headlamp according to an embodiment of the invention is equipped with the shade driving unit for moving the movable shade, which is capable of shading part of light incident on the reflector from the light source, between two positions, each shading the incident light in a different degree. Although the solenoid type shade driving unit is employed, the following effect is achievable as the inverted diode or the capacitor is connected in parallel to the coil of the solenoid in the solenoid driving circuit.

When the movable shade is moved to the second position by displacing the movable iron core to the non-excited position by cutting off the supply of power to the coil of the solenoid, the movable shade is caused to butt against the positioning member generally with strong force because of the elastic urging force of the elastic member.

Since the inverted diode or capacitor in parallel with the coil of the solenoid is connected to the solenoid driving circuit in the vehicle headlamp according to an embodiment of the invention, a current can be made to flow into the coil for a while by the induced electromotive force generated across the coil when the supply of power to the coil of the solenoid is cut off. Then the movable iron core is gradually de-excited to slow the movement of the movable shade. Hence, the movable shade can be prevented from butting against the positioning member with strong force.

Consequently, a large knocking sound can be prevented from being produced by the impact force when the movable shade butts against the positioning member and also a light distribution pattern can be prevented from becoming unstable when switching beams by suppressing the tendency of the movable shade to bounce off toward the first position by the impact force.

In the vehicle headlamp arranged to switch beams by moving the movable shade according to an embodiment of the invention, not only the suppression of the knocking sound but also the stabilization of the light distribution pattern is achievable at the time of switching beams.

The above "positioning member" is not limited to a specific configuration but may be any kind that can be set in the second position by butting against the movable shade when the movable shade is moved to the second position.

If the above "positioning member" is resin-molded, the knocking sound produced when the positioning member butts against the movable shade can be substantially suppressed, further improving the suppression of sound. The "resin" in this case includes fiber-reinforced plastics (FRP).

When the above "positioning member" is made of aluminum alloy, zinc alloy or the like by die casting, excellent durability can be achieved but a large knocking sound may be produced from butting against the movable shade. Therefore, the use of the resin molded part therefor may be particularly effective.

The above "positioning member" may be an independent member or otherwise may be formed integrally with a reflector.

The movable shade should be prevented from deviating while the movable shade stays in the low-beam forming position (where the low-beam emission is made) in the vehicle headlamp. Therefore, the positioning member is preferably positioned by making the positioning member butt against the movable shade in the low-beam position.

The high-beam is emitted when the movable shade is in the first position and the low-beam emission is emitted when it is in the second position. With the above arrangement, the light distribution pattern can be stabilized when the high beam is switched to the low beam. Moreover, the cutoff line of the light distribution pattern is stabilized as the deviation of the movable shade in the low-beam forming position is suppressed.

Thus, the forward visibility is improved.

DETAILED DESCRIPTION OF THE INVENTION

An embodiment of the present invention will now be described with reference to the drawings.

Figure 1:
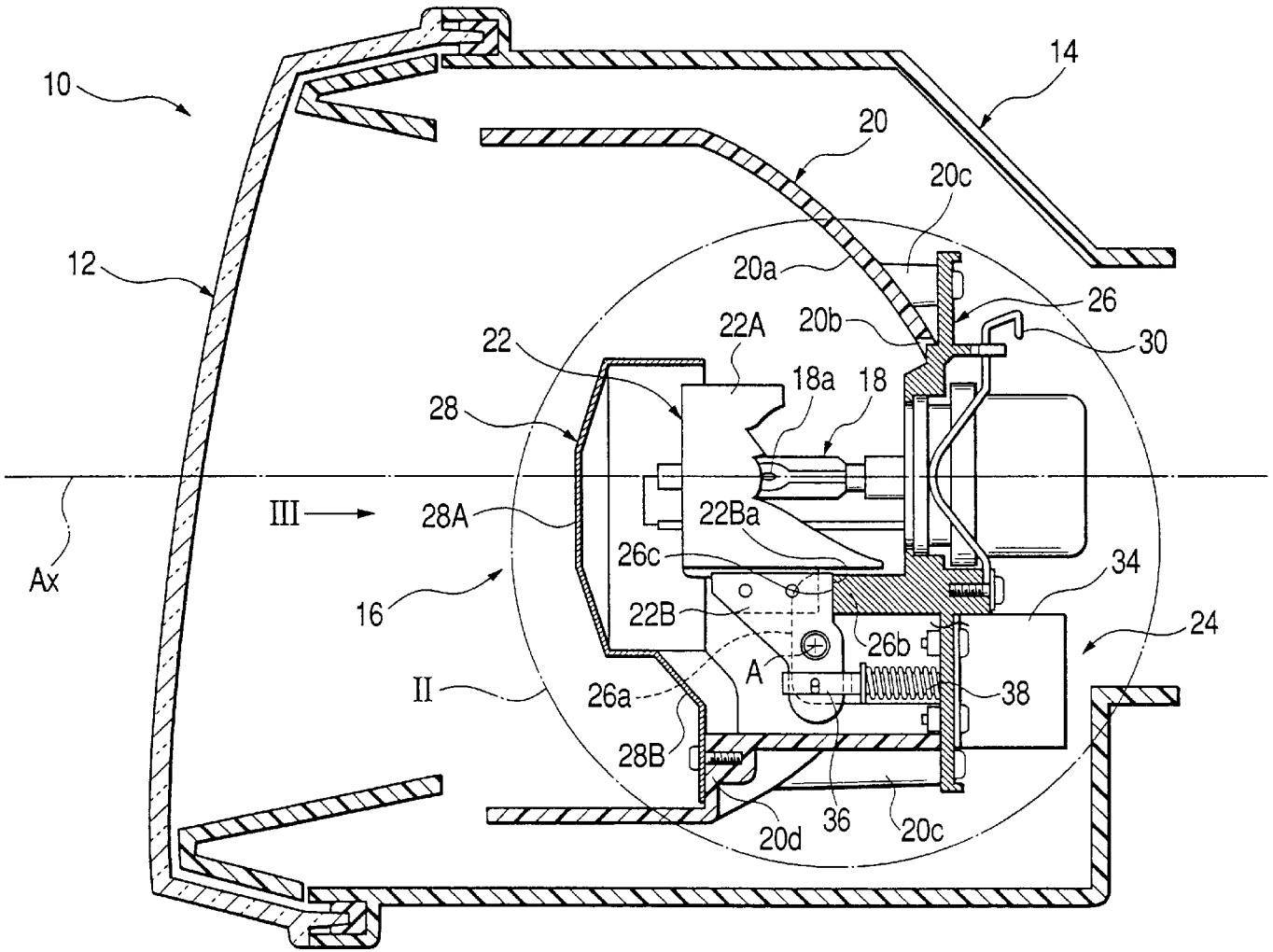
FIG. 1 is a sectional side view of a vehicle headlamp according to an embodiment of the invention.
Figure 2B:
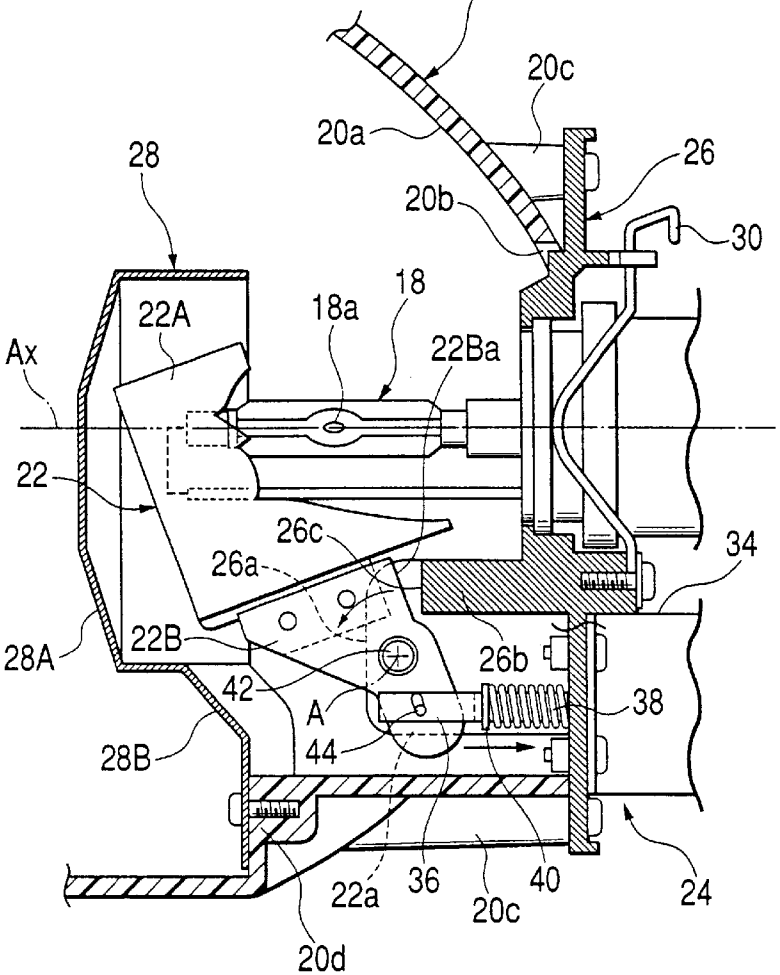
FIG. 2 is a detailed view of region II in FIG. 1.
Figure 2A:
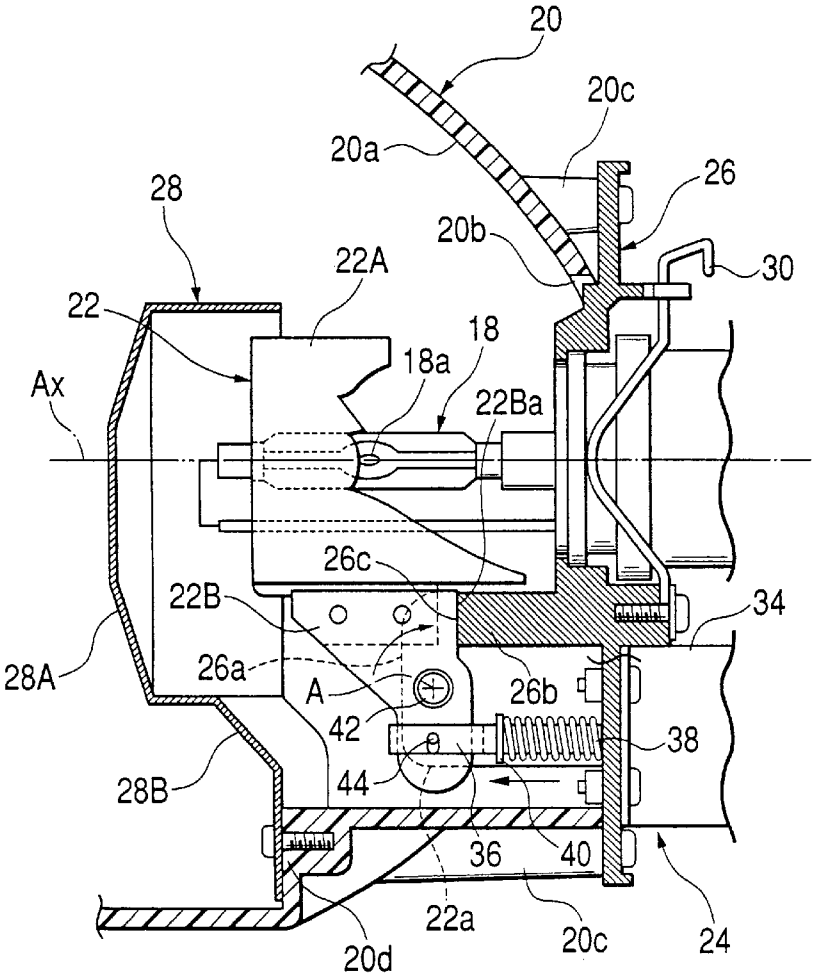
Figure 3:
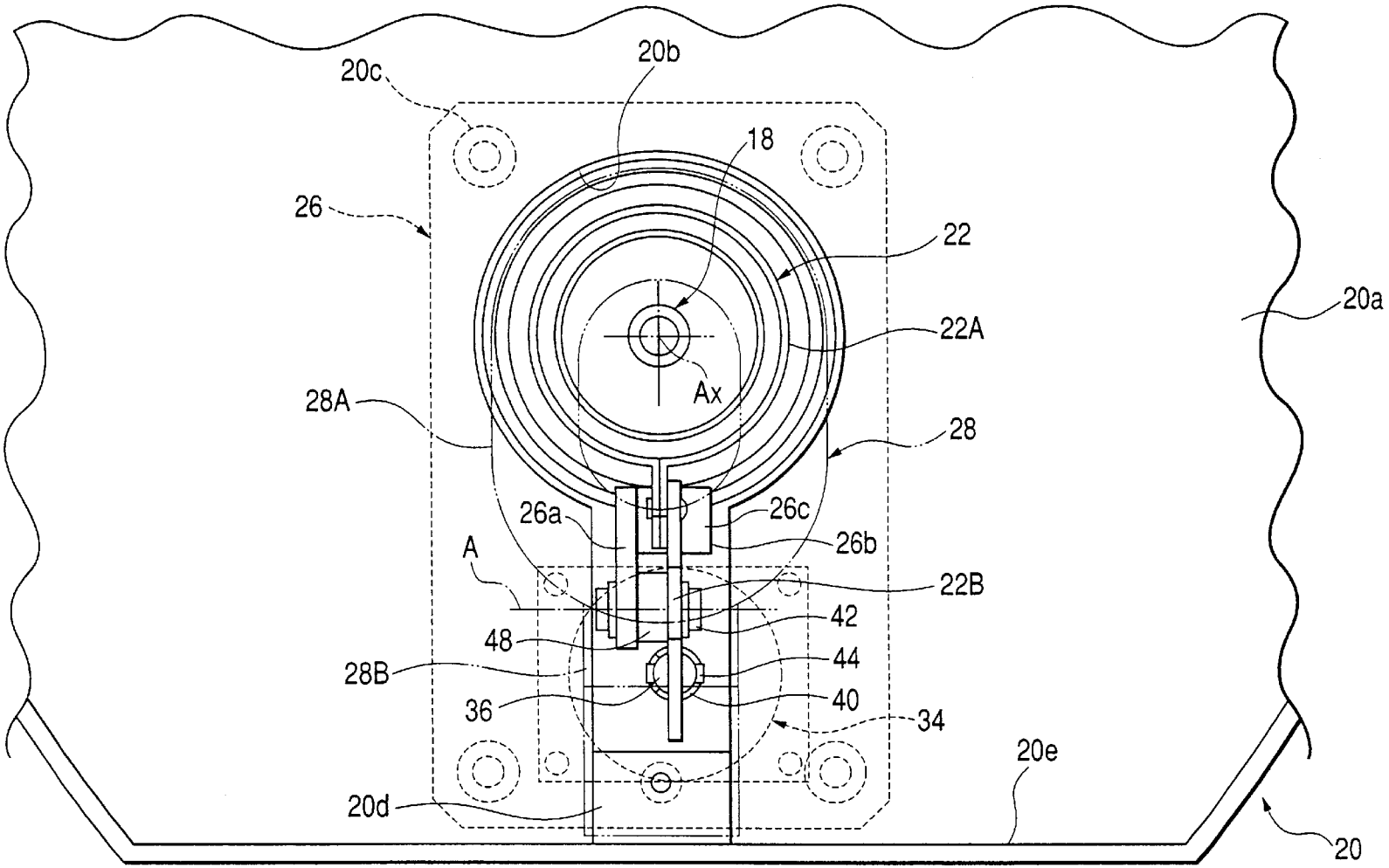
FIG. 3 is a sectional view along line III of FIG. 1.

FIG. 1 is a sectional side view of a vehicle headlamp according to an embodiment of the invention. FIG. 2 is a detail view of region II of FIG. 1. FIG. 3 is a detail view along line III of FIG. 1.

As shown in FIG. 1, a vehicle headlamp 10 according to this embodiment of the invention is such that a reflector unit 16 is set tiltable vertically and horizontally via an aiming mechanism within a lamp chamber formed with a lens 12 and the lamp body 14.

The reflector unit 16 is provided with a discharge bulb (metal halide bulb) 18, a reflector 20, a movable shade 22, a shade driving unit 24, a bulb supporting base 26, and a fixed shade 28.

The lens 12 is a plain-glass lens, and a light distribution control function is given to the reflector unit 16. More specifically, the reflector 20, which is made of FRP (Fibrous glass Reinforced Plastics), has a reflective surface 20*a* for reflecting light forward from the discharge light emitting portion (light source) of the discharge bulb 18 in order to emit beams for use in forming a predetermined light distribution pattern with the diffusion or deflection reflective function of the reflective surface 20*a*.

The discharge bulb 18 is fixedly supported by the reflector 20 via a bulb supporting base 26. The bulb supporting base 26 is made of aluminum alloy by die casting and fixed to a plurality of bosses 20*c* with screws on the back of the reflector 20 in such a state that the bulb supporting base 26 is inserted into the opening portion 20*b* in the rear top of the reflector 20 from the back. The discharge bulb 18 is fixedly supported with the bulb supporting base 26 by a wire spring 30. At this time, the discharge light emitting portion 18*a* of the discharge bulb 18 is positioned on the optical axis Ax of the reflector 20.

The movable shade 22 is a metal member formed with a cylindrical shade body 22A whose rear end edge has a complicated rugged shape, and a plate-like stay 22B extending from the lower end portion of the shade body 22A downward and slightly rearward, these shade body and the stay being riveted.

The movable shade 22 is allowed by the shade driving unit 24 to take a low-beam position as shown in FIG. 2(*a*) and a high-beam position as shown in FIG. 2(*b*). Further, the movable shade 22 uses the shade body 22A to shade part of light incident on the reflective surface 20*a* of the reflector 20 from the discharge light emitting portion 18*a* of the discharge bulb 18 in the low-beam position so as to make light necessary for emitting a low beam incident on the reflective surface 20*a* .I In the high-beam position, the movable shade 22 operates to secure a quantity of light necessary for high-beam irradiation by reducing the shading quantity of light incident on the reflective surface 20*a* with the shade body 22A.

The shade driving unit 24 includes a solenoid 34 fixedly screwed to the bulb supporting base 26 under the optical axis Ax of the reflector 20, and a return spring 38 fitted to a movable iron core 36 of the solenoid 34 and used to urge the movable iron core 36 toward a non-excited position.

The movable iron core 36 is equipped with an E-ring 40 in its intermediate portion for stopping the elastic urging force of the return spring 38 by abutting against the front end portion of the return spring 38, its front end portion being laterally forked.

The movable shade 22 is pivotally supported around a pivotal axis A laterally extending via a shaft member 42 formed in such a way as to protrude forward from the bulb supporting base 26 in the intermediate portion of its stay 22B. In this case, an annular spacer 48 is installed between the stay 22B and a support bracket 26*a*, so that the looseness of the coupling portion between the stay 22B and the shaft member 42 is minimized.

The movable shade 22 is coupled to the front end portion of the movable iron core 36 via a pin 44 in the lower end portion of the stay 22B in such a way that while the front end portion of the stay 22B is laterally clamped with the forked front end portion of the movable iron core 36, the movable shade 22 is fixed to the front end portion by laterally passing the pin 44 therethrough. A slit 22*a* for receiving the pin 44 is formed in the front end portion of the stay 22B so as to extend vertically. The variation in the distance between the shaft member 42 and the pin 44 is absorbed as the movable shade 22 pivots.

A positioning projected portion 26*b* (positioning member) projecting forward is formed in a region close to the base portion of the support bracket 26*a* on the bulb supporting base 26. The rear end edge 22B*a* of the stay 22B butts against the front edge face 26*c* so as to set the movable shade 22 in the low-beam position.

The fixed shade 28 for covering the movable shade 22 is provided substantially ahead of the movable shade 22. The fixed shade 28 is formed integrally with a cap-like shade body 28A in the form of a vertically-long ellipse, and a sectionally U-shaped stay 28B extending from the lower end portion of the shade body 28A downward close to the rear side. Further, the fixed shade 28 is fixed to the reflector 20 with the screw in the lower end portion of the stay 28B. A shade fixing seat portion 20*d* is projected from the lower end portion of the reflective surface 20*a* in the reflector 20.

Figure 4B:
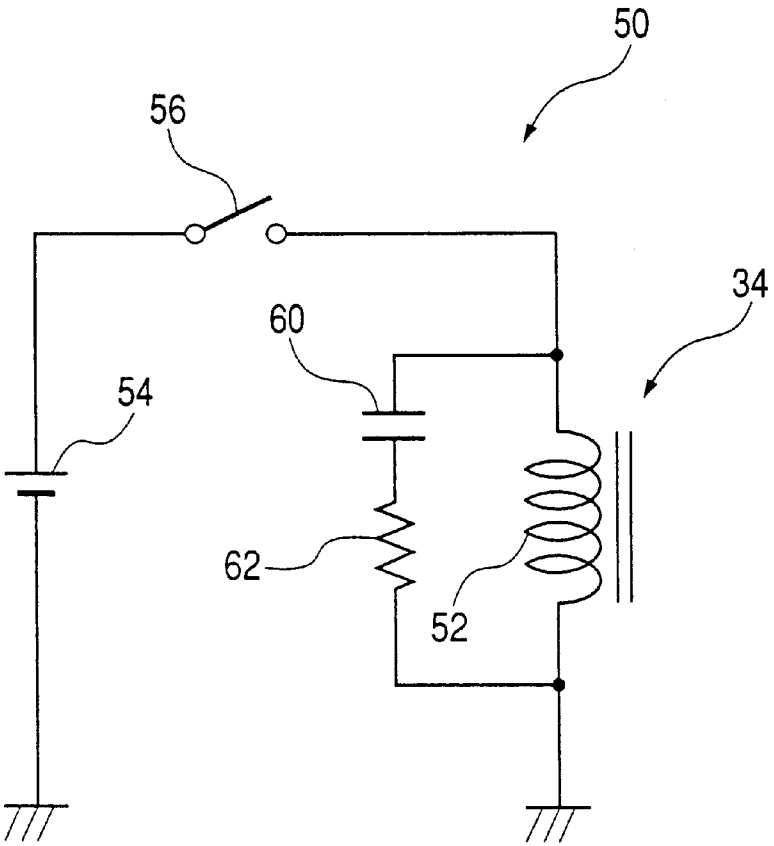
FIG. 4 is a circuit diagram of a solenoid driving circuit of the vehicle headlamp according to an embodiment of the invention.
Figure 4A:
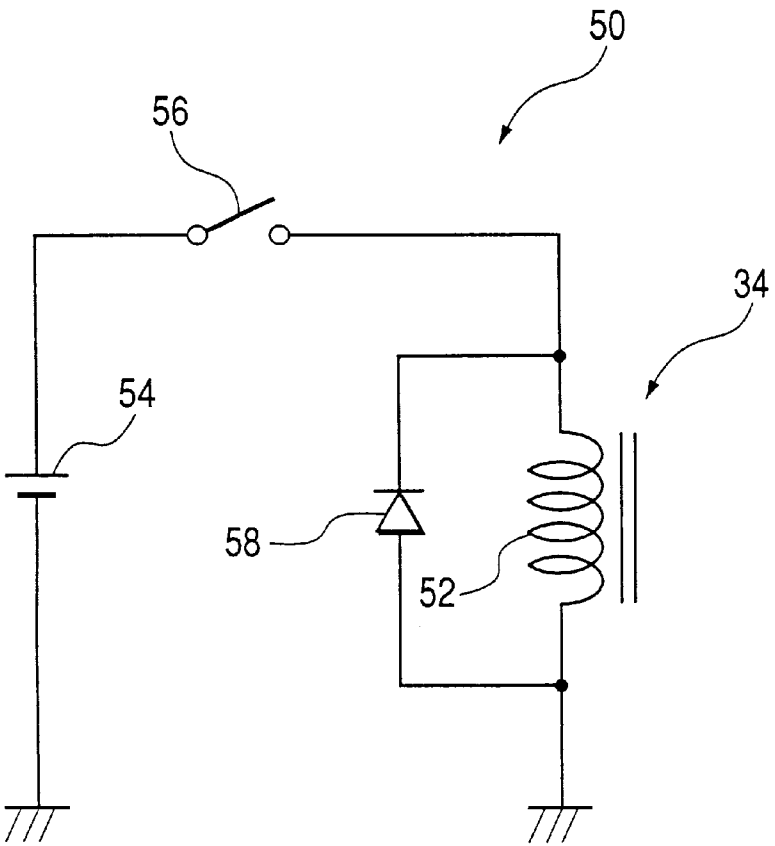

FIG. 4(*a*) shows a circuit diagram of a solenoid driving circuit 50 for driving the solenoid 34.

In the solenoid driving circuit 50, as shown in FIG. 4(*a*), the coil 52 of the solenoid 34 is connected to a battery power supply 54 and a beam changeover switch 56 and also connected to an inverted diode 58 in parallel.

In the solenoid driving circuit 50, the movable iron core 36 is displaced toward the excited position against the elastic urging force of the return spring 38 by turning on the beam changeover switch 56 to supply power to the coil 52, and is also displaced toward the non-excited position using the elastic urging force thereof by turning off the beam changeover switch 56 to cut off the power thereto.

However, since the inverted diode 58 is connected to the coil 52 in parallel, current is kept flowing through the coil 52 for a while because of the induced electromotive force generated across the coil 52, so that the movable iron core 36 is gradually de-excited.

The high beam is switched by the shade driving unit 24 to the low beam as follows:

When the beam changeover switch 56 is turned on, the movable iron core 36 of the solenoid 34 is de-excited and displaced forward because of the elastic urging force of the return spring 38. Thus, the movable shade 22 is pivoted backward around the pivotal axis A, and the rear end edge 22B*a* of the stay 22B butts against the front edge face 26*c* of the positioning projected portion 26*b* of the bulb supporting base 26, so that the movable shade 22 is set in the low-beam position. However, the moving speed of the movable shade 22 is lowered as the movable iron core 36 is gradually de-excited by the inverted diode 58 connected to the coil 52 in parallel. Consequently, the movable shade does not butt against the front edge face 26*c* of the positioning projected portion 26*b* with great force. In this case, the front edge face 26*c* of the positioning projected portion 26*b* is so positioned that a certain degree of elastic urging force is still left in the return spring 38 in the above contact condition. As the positioning of the movable shade 22 is thus ensured, the longitudinal deviation of the movable shade 22, which may result from the vibration of the traveling vehicle, can effectively be prevented.

On the other hand, the low beam is switched by the shade driving unit 24 to the high beam as follows:

The movable iron core 36 of the solenoid 34 is excited when the beam changeover switch 56 is turned on and displaced backward against the elastic urging force of the return spring 38 up to the excitation position. Thus, the movable shade 22 is pivoted forward by a predetermined angle around the pivotal axis A, and set in the high-beam position.

As set forth above in detail, the vehicle headlamp 10 according to an embodiment of the invention is equipped with the shade driving unit 24 for pivoting the movable shade 22 between at least two positions where the incident light is shaded in different degrees. The movable shade 22 is capable of shading part of light incident on the reflective surface 20*a* of the reflector 20 from the discharge light emitting portion 18*a* of the discharge bulb 18. The use of the solenoid type shade driving unit 24 makes the following effect achievable since the inverted diode 58 in parallel with the coil 52 of the solenoid 34 is connected to the solenoid driving circuit 50.

Specifically, the shade driving unit 24 operates to move the movable shade 22 to the low-beam position by displacing the movable iron core 36 toward the non-excited position by cutting off the supply of power to the coil 52 of the solenoid 34. When the movable shade 22 is moved to the low-beam position, the movable shade 22 is generally caused to strongly butt against the positioning projected portion 26*b* because of the elastic urging force of the return spring 38.

According to the embodiment of the invention, however, the inverted diode 58 in the solenoid driving circuit 50 keeps current flowing through the coil 52 for a while because of the induced electromotive force generated across the coil 52 when the supply of power to the coil 52 of the solenoid 34 is cut off. Accordingly, the movable iron core 36 is gradually de-excited to decrease the moving speed of the movable shade 22 so as to prevent the movable shade 22 from strongly butting against the positioning projected portion 26*b*.

Consequently, a large knocking sound can be prevented from being produced by the impact force when the movable shade butts against the positioning member and also a light distribution pattern can be prevented from becoming unstable when switching beams by suppressing the movable shade from bouncing off toward the first position by the impact force. In particular, since the light distribution pattern f or the low beam has a cutoff line, stabilizing the light distribution pattern while suppressing the deviation of the movable shade 22 would be extremely effective in improving light visibility.

In the vehicle headlamp arranged to switch beams between the high and low beams by moving the movable shade according to this embodiment of the invention, the generation of the knocking sound can be suppressed and the light distribution pattern can be stabilized when the high beam is switched to the low beam.

As the positioning projected portion 26*b* is formed integrally with the bulb supporting base 26 made by die casting, this combination has excellent durability. However, in terms of suppressing the knocking sound, the aforementioned structure is preferred because of a possible large knocking sound of metal hitting against metal.

Although, only the inverted diode 58 is connected to the coil 52 of the solenoid 34 in parallel according to this embodiment of the invention, a resistor may be connected to the inverted diode 58 in series. When the supply of power to the coil 52 is cut off, a current resulting from the induced electromotive force may not flow through the coil 52 as much. Thus, the moving speed of the movable shade 22 may be increased to that extent. If the inverted diode 58 lowers the moving speed of the movable shade 22 too much, speed adjustment may be made by the use of the resistor.

Instead of connecting the inverted diode 58 to the coil 52 in parallel as in this embodiment of the invention, a capacitor 60 may be connected to the coil 52 in parallel as shown in FIG. 4(*b*) so as to lower the moving speed of the movable shade 22 to prevent the movable shade 22 from strongly butting against the positioning projected portion 26*b*. Even in this case, a resistor 62 may be connected to the capacitor 60 as shown in FIG. 4(*b*) to facilitate the adjustment of the moving speed of the movable shade 22.

Figure 5:
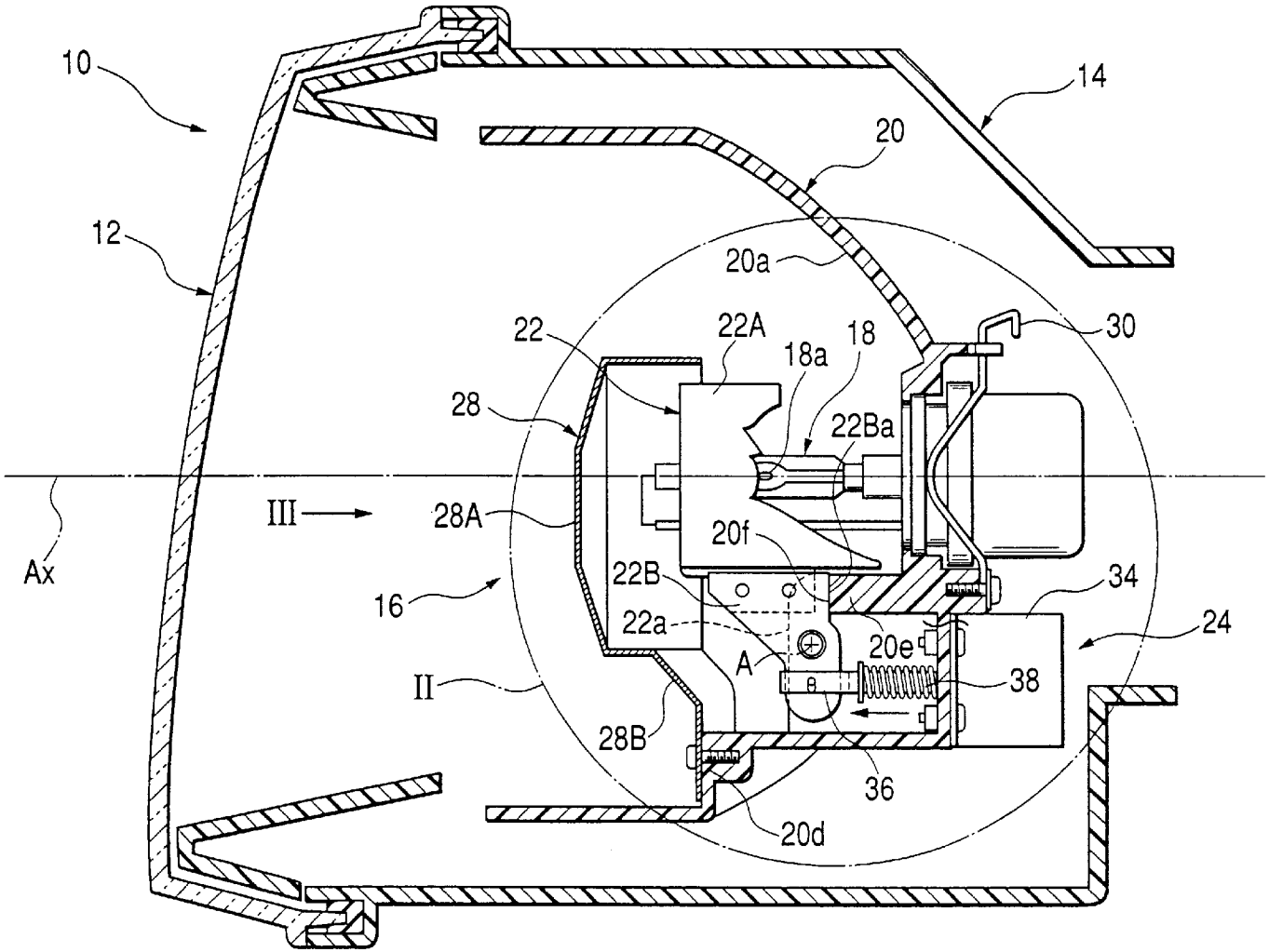
FIG. 5 is another embodiment of the invention.

FIG. 5 shows another embodiment of the invention similar to FIG. 1.

As shown in FIG. 5, according to another embodiment of the invention, the bulb supporting base 26 according to the foregoing embodiment thereof is not employed but the discharge bulb 18 and the shade driving unit 24 are directly fitted to the FRP reflector 20. In this embodiment of the invention, further, a positioning projected portion 20*e* similar to the positioning projected portion 26*b* according to the foregoing embodiment thereof is formed integrally with the reflector 20.

Although the positioning projected portion 20*e* is also made of FRP according to this embodiment of the invention, the effect of suppressing knocking sound at the time of switching beams is increased because the knocking sound generated when the movable shade 22 butts against the front edge face 20*f* of the positioning projected portion 20*e* is suppressed with the aid of the inverted diode 58.

The use of the bulb supporting base 26 made of resin such as FRP in the above embodiment of the invention makes achievable the same effect as in the foregoing embodiments.

The present invention claims priority from Japanese patent application serial no. H11-297482, which is incorporated herein by this reference in its entirety.

Several embodiments of the invention have been described herein, but it should be understood that various additions and modifications could be made which fall within the scope of the following claims.

What is claimed is:

1. A vehicle headlamp comprising:

a light source;

a reflector for reflecting light from said light source forward;

a movable shade capable of shading part of light incident on said reflector from the light source;

a shade driving unit for moving the movable shade between a first and a second position where an incident light shading quantity has different values, said shade driving unit including a solenoid and an elastic member for urging a movable iron core of the solenoid toward a non-excited position, and for operating to move said movable shade to said first position by displacing said movable iron core to an excited position when power is supplied to the coil of said solenoid and also to move said movable shade to said second position by displacing said movable iron core to said non-excited position when the supply of power to said coil is cut off;

a positioning member for positioning said movable shade to said second position by butting against said movable shade when said movable shade moves to said second position; and a solenoid driving circuit for driving said solenoid, said solenoid driving circuit being configured to decreasingly provide current to the coil of the solenoid when power to the coil is cut off, thereby inducing an electromotive force across the coil such that the movable iron core is gradually de-excited to prevent the movable shade from strongly butting against the positioning member.

2. The vehicle headlamp as claimed in claim 1, wherein said positioning member is resin-molded.

3. The vehicle headlamp as claimed in claim 1, wherein said positioning member is formed by die casting.

4. The vehicle headlamp as claimed in claim 1, wherein said movable shade is used to emit a high beam while it is in the first position, whereas said movable shade is used to emit a low beam while it is in the second position.

5. The vehicle headlamp according to claim 1, wherein the solenoid driving circuit comprises an inverted diode or a capacitor connected in parallel to said coil.

6. A vehicle headlamp comprising:

a light source;

a reflector disposed around said light source for reflecting light forwardly from said light source;

a movable shade disposed in front of said light source for shading part of light incident on said reflector from the light source;

a shade driving unit having a solenoid, which is disposed below the movable shade for moving the movable shade between a first and a second position, each providing a different degree of screening of light from said light source;

a positioning member for positioning said movable shade to said second position by butting against said movable shade when said movable shade moves to said second position; and a solenoid driving circuit for driving said solenoid, said solenoid driving circuit being configured to decreasingly provide current to the coil of the solenoid when power to the coil is cut off.

7. The vehicle headlamp of claim 6, wherein said shade driving unit further comprises:

a movable iron core disposed inside said solenoid and connected to said movable shade; and an elastic member attached to said movable iron core to provide force to move said movable shade to the second position;

wherein said shade driving unit can excite said movable iron core against the force of said elastic member to move said movable shade to said first position and can release said movable iron core to let said elastic member move back said movable shade to said second position.

8. The vehicle headlamp of claim 6, wherein a resistor is connected to said inverted diode or capacitor in series.

9. The vehicle headlamp as claimed in claim 6, wherein said positioning member is resin-molded.

10. The vehicle headlamp as claimed in claim 6, wherein said positioning member is formed by die casting.

11. The vehicle headlamp as claimed in claim 6, wherein a high beam is emitted when said movable shade is in the first position, whereas a low beam is emitted when said movable shade is in the second position.

12. The vehicle headlamp according to claim 6, wherein the solenoid driving circuit comprises an inverted diode or a capacitor connected in parallel to said coil.

* * * * *